US010178461B1

(12) United States Patent
Lu

(10) Patent No.: US 10,178,461 B1
(45) Date of Patent: Jan. 8, 2019

(54) AUDIO EAR BUDS

(71) Applicant: YaYuan Lu, Tanzhou Town (CN)

(72) Inventor: YaYuan Lu, Tanzhou Town (CN)

(73) Assignee: Steve Beutner, Riverview, MI (US)

( * ) Notice: Subject to any disclaimer, the term of this patent is extended or adjusted under 35 U.S.C. 154(b) by 0 days.

(21) Appl. No.: 15/866,788

(22) Filed: Jan. 10, 2018

Related U.S. Application Data

(60) Provisional application No. 62/537,128, filed on Jul. 26, 2017.

(51) Int. Cl.
*H04R 1/10* (2006.01)
*H04R 3/04* (2006.01)
*H04R 1/22* (2006.01)

(52) U.S. Cl.
CPC ..... *H04R 1/1016* (2013.01); *H04R 1/105* (2013.01); *H04R 1/22* (2013.01); *H04R 3/04* (2013.01)

(58) Field of Classification Search
USPC ..... 381/380, 351
See application file for complete search history.

(56) References Cited

U.S. PATENT DOCUMENTS

2016/0295315 A1* 10/2016 Kuwahara ..... H04R 1/1016

* cited by examiner

*Primary Examiner* — Daniel Swerdlow
(74) *Attorney, Agent, or Firm* — Donald J. Ersler

(57) ABSTRACT

Audio ear buds preferably include a housing, an ear tip, an audio speaker, a chamber divider and a power line. The housing preferably includes a driver cup and a chamber cup. The ear tip is attached to the driver cup. A speaker cavity is formed in the driver cup. The speaker cavity is sized to receive the audio speaker. The driver cup is inserted into the chamber cup. The chamber cup includes a divider bore and an acoustic cavity bore, which are sized to receive the chamber divider. A sound hole is formed through a wall of the chamber cup into the acoustic cavity bore. The chamber divider includes at least one air passage hole. The chamber divider creates a ported speaker chamber and an acoustic chamber. The chamber divider acts as a passive resonator. The power line supplies power to the audio speaker.

12 Claims, 1 Drawing Sheet

AUDIO EAR BUDS

CROSS-REFERENCES TO RELATED APPLICATIONS

This is a utility patent application taking priority from provisional application No. 62/537,128 filed on Jul. 26, 2017.

BACKGROUND OF THE INVENTION

1. Field of the Invention

The present invention relates generally to audio equipment and more specifically to audio ear buds, which provide improved audio listening performance relative to that of the prior art.

2. Discussion of the Prior Art

Many people may prefer to listen to music through ear buds rather than loudspeakers. Listening to music through ear buds or headphones allows the listener to hear more intricacies in a musical recording. Unfortunately, the quality of prior art ear buds is not optimal. Some ear buds use noise cancellation technology, which alters the sound of music. Ear buds also have difficulties playing low frequencies.

Accordingly, there is a clearly felt need in the art for audio ear buds, which include dual audio chambers and a passive resonator that improves bass frequency response.

SUMMARY OF THE INVENTION

The present invention provides audio ear buds, which provide improved audio listening performance relative to that of the prior art. The audio ear buds preferably include a housing, an ear tip, an audio speaker, a chamber divider and a power line. The housing preferably includes a driver cup and a chamber cup. The driver cup preferably includes a base cup member and an ear tip projection. The base cup preferably includes a round cross section. The ear tip projection extends from one end of the base cup member. The ear tip projection includes a tip sound hole to allow the transmission of audio sound from the audio speaker. The ear tip includes an ear portion and a cylindrical receiver portion. The ear portion preferably includes a substantially spherical shape. The cylindrical receiver portion is disposed in an inner surface of the ear portion. A tip projection bore is formed in the cylindrical receiver portion to receive the ear tip projection. The ear tip projection may be bonded in the projection bore.

A speaker cavity is formed in an opposing end of the base cup member. The speaker cavity is sized to receive an outer perimeter of the audio speaker. The audio driver may be secured in the speaker cavity with a press fit, bonding agent or any other suitable process. A recessed lip is formed on the opposing end of the base cup to receive the chamber cup. The chamber cup preferably includes an acoustic cavity. The acoustic cavity includes a divider bore and a tapered acoustic cavity bore. The acoustic cavity bore is formed on a bottom of the chamber cup. The divider bore is formed at an entrance to the acoustic cavity bore. A bottom of the divider bore and an entrance to the acoustic cavity bore are sized to receive the flexible chamber divider. The divider bore is sized to receive the recessed lip. A sound hole is formed through a wall of the chamber cup into the acoustic cavity bore. A power hole is formed through the wall of the chamber cup into acoustic chamber to provide clearance for the power line.

The chamber divider preferably includes a cylindrical rim and a tapered cup. The tapered cup extends from a bottom of the cylindrical rim. An air passage hole and a power line hole are formed through a bottom of the tapered cup. The chamber divider is fabricated from a flexible material, which is capable of transmitting sound waves from the audio speaker to the acoustic chamber. The chamber divider creates a ported speaker chamber from the speaker cavity and a acoustic chamber from the acoustic cavity. The chamber divider also acts as a passive resonator by transmitting out-of-phase bass frequencies to the acoustic chamber. Air will be able to flow through the air passage hole in the chamber divider. Air will be able to flow in and out of the acoustic chamber through the sound hole. The power line includes positive and negative wires for electrically driving the audio speaker. An end of the power line is retained in the power hole. The positive and negative wires are inserted through a power line hole in the chamber divider.

In use, the audio speaker generates audio sound from a front thereof. The audio sound travels through the tip sound hole in the ear tip projection and through an ear tip hole formed through the ear tip. An out-of-phase sound wave from a rear of the audio speaker contacts the chamber divider and forces thereof to vibrate and transmit the sound wave from the rear of the audio speaker into the acoustic chamber, which improves the bass response of the audio ear bud. Air is free to travel into the acoustic chamber from the sound hole and through the air passage hole for use by the audio speaker. The ported speaker chamber enables a speaker cone of the audio speaker to have greater travel and thus provide improved bass response.

Accordingly, it is an object of the present invention to provide audio ear buds, which include dual audio chambers and a passive resonator that improve bass frequency response.

These and additional objects, advantages, features and benefits of the present invention will become apparent from the following specification.

DETAILED DESCRIPTION OF THE PREFERRED EMBODIMENTS

Figure 2:
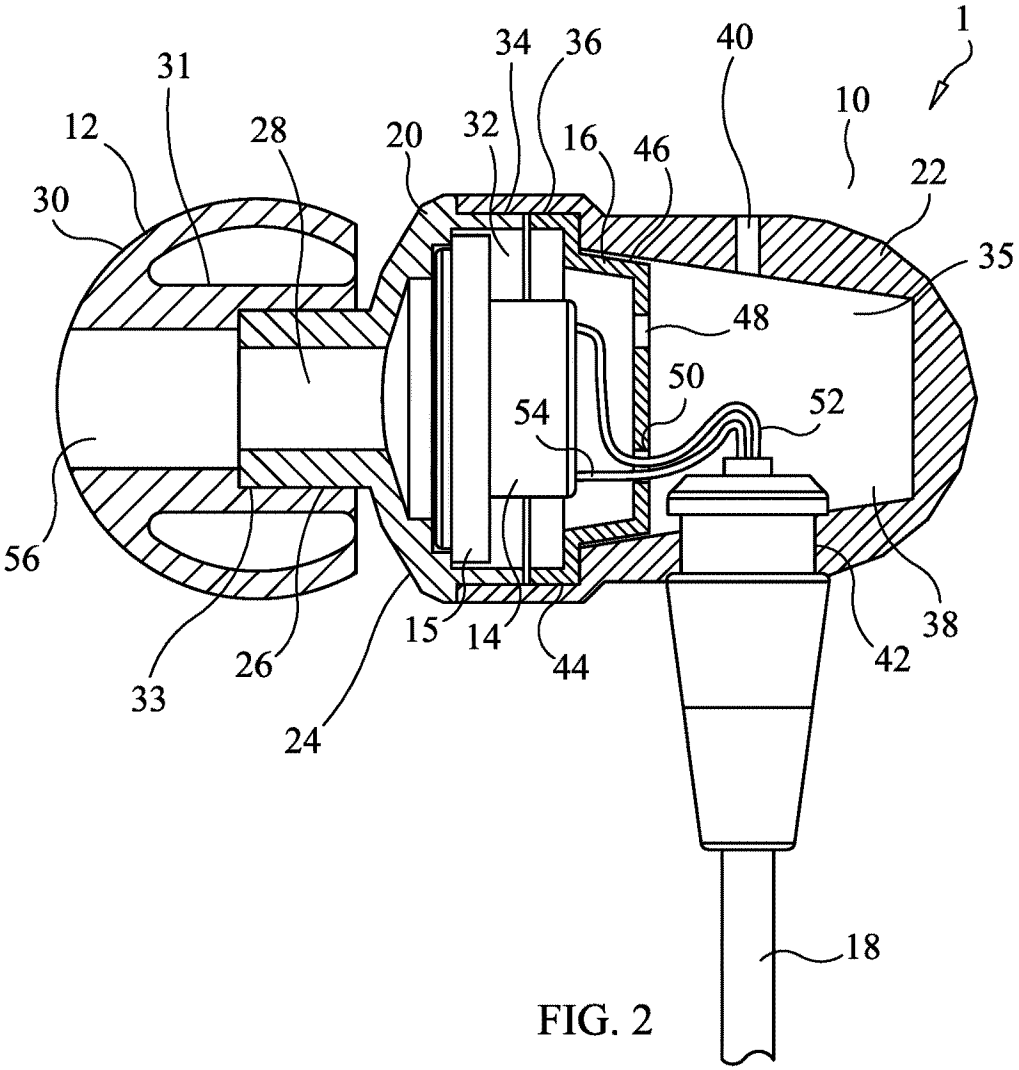
FIG. 2 is a cross sectional view of an audio ear bud cut through FIG. 1 in accordance with the present invention.
Figure 1:
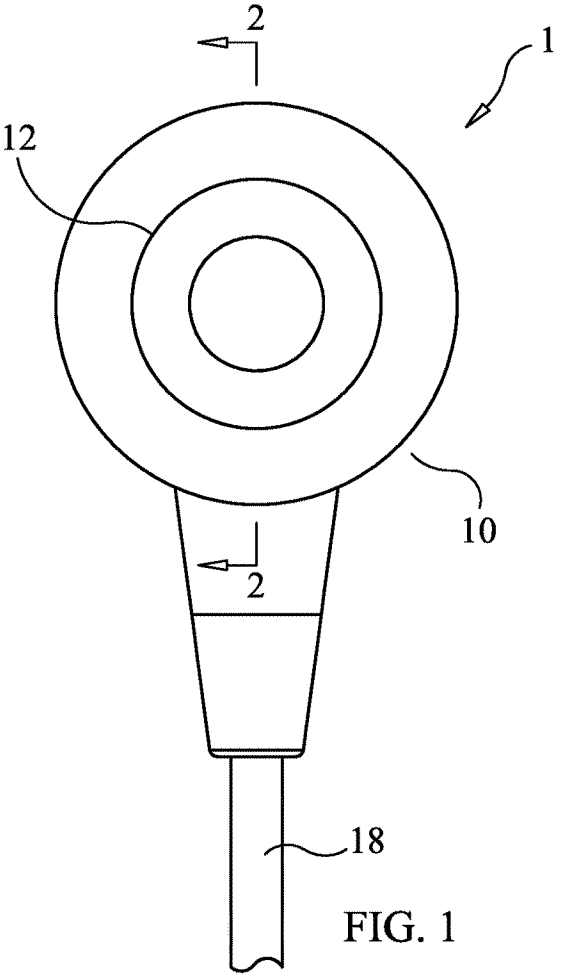
FIG. 1 is a front view of an audio ear bud in accordance with the present invention.

With reference now to the drawings, and particularly to FIG. 2, there is shown a cross sectional view of an audio ear bud 1. With reference to FIG. 1, the audio ear bud 1 preferably includes a housing 10, an ear tip 12, an audio speaker 14, a chamber divider 16 and a power line 18. The housing 10 preferably includes a driver cup 20 and a chamber cup 22. The driver cup 20 includes a base cup member 24 and an ear tip projection 26. The base cup 24 preferably includes a round cross section. The ear tip projection 26 extends from one end of the base cup member 24. The ear tip projection 26 includes a tip sound hole 28 to allow the transmission of audio sound from a speaker cone 15 of the audio speaker 14. The ear tip 12 includes an ear portion 30 and a cylindrical receiver portion 31. The ear portion 30 preferably includes a substantially spherical shape. The cylindrical receiver portion 31 is disposed in an inner surface of the ear portion 30. A tip projection bore 33 is formed in the cylindrical receiver portion 31 to receive the ear tip projection 26. The ear tip projection 26 may be bonded in the projection bore 33. The ear tip 12 is fabricated from a soft material for contact with an ear.

A speaker cavity 32 is formed in an opposing end of the base cup member 20. The speaker cavity 32 is sized to receive an outer perimeter of the audio speaker 14. The audio driver 14 may be secured in the speaker cavity 32 with a press fit, bonding agent or any other suitable process. A recessed lip 34 is formed on the opposing end of the base cup member 20 to receive the chamber cup 22. The chamber cup 22 preferably includes an acoustic cavity 35. The acoustic cavity 35 includes a divider bore 36 and a tapered acoustic cavity bore 38. The acoustic cavity bore 38 is formed on a bottom of the chamber cup 22. The divider bore 36 is formed at an entrance to the acoustic cavity bore 38. A bottom of the divider bore 36 and an entrance to the acoustic cavity bore 38 are sized to receive the chamber divider 16. The divider bore 36 is sized to receive the recessed lip 34. A sound hole 40 is formed through a wall of the chamber cup 22 into the acoustic cavity bore 38. A power hole 42 is formed through the wall of the chamber cup 22 into acoustic chamber 38 to provide clearance for the power line 18.

The chamber divider 16 preferably includes a cylindrical rim 44 and a tapered cup 46. The tapered cup 46 extends from a bottom of the cylindrical rim 44. An air passage hole 48 and a power line hole 50 are formed through a bottom of the tapered cup 46. The chamber divider 16 is fabricated from a flexible material, which is capable of transmitting sound waves from the audio speaker 14 to the acoustic cavity 35. The chamber divider 16 creates a ported speaker chamber from the speaker cavity 32 on one side of the chamber divider 16 and an acoustic chamber from the acoustic cavity 35 on an opposing side of the chamber divider 16. The chamber divider 16 also acts as a passive resonator by transmitting out of phase bass frequencies to the acoustic cavity 36. Air will be able to flow through the air passage hole 48 in the chamber divider 16. Air will be able to flow in and out of the acoustic cavity 35 through the sound hole 40. The power line 18 includes a positive wire 52 and a negative wire 54 for electrically driving the audio speaker 14. The audio speaker 14 provides an output of audio sound in response to an electrical signal from the positive and negative wires 52, 54. An end of the power line 18 is retained in the power hole 42. The positive and negative wires 52, 54 are inserted through the power line hole 50 in the chamber divider 16.

In use, the audio speaker 14 generates audio sound from a front thereof. The audio sound travels through the tip sound hole 28 in the ear tip projection 26 and through an ear tip hole 56 formed through the ear tip 12. An out-of-phase sound wave from a rear of the audio speaker 14 contacts the chamber divider 16 and forces the chamber divider 16 to vibrate and transmit the sound wave from the rear of the audio speaker 14 into the acoustic cavity 38, which improves the bass response of the audio ear bud 1. Air is free to travel into the acoustic cavity 38 and through the air passage hole 48 for use by the audio speaker 14. The speaker cavity 32 enables the speaker cone 15 of the audio speaker 14 to have greater travel and thus provide improved bass response.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An audio ear bud comprising:

a housing includes a driver cup and a chamber cup, said driver cup includes a speaker cavity, a tip sound hole is formed through a front of said driver cup to said speaker cavity, said chamber cup includes an acoustic cavity;

an audio speaker is retained in said speaker cavity, a speaker cone of said audio speaker faces said tip sound hole; and a chamber divider is sized to be received by said acoustic chamber, said chamber divider includes at least one air hole formed there through, said chamber divider creates a ported speaker chamber from said speaker cavity on one side thereof, said chamber divider creates an acoustic chamber from said acoustic cavity on an opposing side thereof, said chamber divider is fabricated from a flexible material such that said chamber divider acts as a passive resonator to emit audio sound, wherein an electrical signal is feed into said audio speaker to emit audio sound from said speaker cone.

2. The audio ear bud of claim 1, further comprising:

an ear tip is attached to said front of said driver cup, said ear tip includes an ear tip hole.

3. The audio ear bud of claim 2 wherein:

an ear tip projection extends from a front of said driver cup, said ear tip is retained on said ear tip projection.

4. The audio ear bud of claim 1, further comprising:

an electrical cord includes a positive wire and a negative wire, an end of said electrical cord is retained in said chamber cup, said positive and negative wires provide an audio signal to said audio speaker.

5. The audio ear bud of claim 1 wherein:

said chamber divider includes a cylindrical rim and a tapered cup, said tapered cup extends from a bottom of said cylindrical rim.

6. The audio ear bud of claim 5 wherein:

said acoustic chamber includes a divider bore and a tapered acoustic cavity bore, said acoustic cavity bore is formed on a bottom of said chamber cup, said divider bore is formed at an entrance to said acoustic cavity bore, a bottom of said divider bore and an entrance to said acoustic cavity bore are sized to receive said chamber divider.

7. An audio ear bud comprising:

a housing includes a driver cup and a chamber cup, said driver cup includes a speaker cavity, a tip sound hole is formed through a front of said driver cup to said speaker cavity, said chamber cup includes an acoustic cavity, a sound hole is formed through a wall of said chamber cup to said acoustic cavity;

an audio speaker is retained in said speaker cavity, a speaker cone of said audio speaker faces said tip sound hole; and a chamber divider is sized to be received by said acoustic chamber, said chamber divider includes at least one air hole formed there through, said chamber divider creates a ported speaker chamber from said speaker cavity on one side thereof, said chamber divider creates an acoustic chamber from said acoustic cavity on an opposing side thereof, said chamber divider is fabricated from a flexible material such that said chamber divider acts as a passive resonator to emit audio sound, wherein an electrical signal is feed into said audio speaker to emit audio sound from said speaker cone.

8. The audio ear bud of claim 7, further comprising:

an ear tip is attached to said front of said driver cup, said ear tip includes an ear tip hole.

9. The audio ear bud of claim 8 wherein:

an ear tip projection extends from a front of said driver cup, said ear tip is retained on said ear tip projection.

10. The audio ear bud of claim 7, further comprising:

an electrical cord includes a positive wire and a negative wire, an end of said electrical cord is retained in said chamber cup, said positive and negative wires provide an audio signal to said audio speaker.

11. The audio ear bud of claim 7 wherein:

said chamber divider includes a cylindrical rim and a tapered cup, said tapered cup extends from a bottom of said cylindrical rim.

12. The audio ear bud of claim 11 wherein:

said acoustic chamber includes a divider bore and a tapered acoustic cavity bore, said acoustic cavity bore is formed on a bottom of said chamber cup, said divider bore is formed at an entrance to said acoustic cavity bore, a bottom of said divider bore and an entrance to said acoustic cavity bore are sized to receive said chamber divider.

* * * * *